US005362945A

United States Patent [19]

Baader

[11] Patent Number: 5,362,945

[45] Date of Patent: Nov. 8, 1994

[54] GODET FOR HEATING AN ADVANCING YARN

[75] Inventor: Uwe Baader, Wuppertal, Germany

[73] Assignee: Barmag AG, Remscheid, Germany

[21] Appl. No.: 873,414

[22] Filed: Apr. 24, 1992

[51] Int. Cl.[5] ..... H05B 6/14

[52] U.S. Cl. ..... 219/619; 219/469; 219/671; 363/48; 363/89

[58] Field of Search ..... 219/10.492, 10.491, 219/10.61 R, 10.61 A, 10.77, 10.79, 618, 619, 640, 671, 674, 469; 363/48, 89; 307/35; 318/432

[56] References Cited

U.S. PATENT DOCUMENTS

| | | | |
|---|---|---|---|
| 3,412,229 | 11/1960 | Seagrave | 291/10.61 R |
| 3,435,171 | 3/1969 | Lohest | 219/10.61 R |
| 3,448,233 | 6/1969 | Landis | 219/10.61 R |
| 3,487,187 | 12/1969 | Martens et al. | 219/10.61 R |
| 3,508,024 | 4/1970 | Cannon | 219/10.61 A |
| 3,562,489 | 2/1971 | Lenk | 219/469 |
| 3,581,060 | 5/1971 | Bauer et al. | 219/10.61 R |
| 4,369,490 | 1/1983 | Blum | 363/48 |
| 4,426,564 | 1/1984 | Stiegerwald et al. | 219/10.77 |
| 4,562,389 | 12/1985 | Jundt et al. | 318/432 |
| 4,675,487 | 6/1987 | Verkasalo | 219/10.43 |
| 4,775,773 | 10/1988 | Verkasalo | 219/10.61 R |
| 5,027,002 | 6/1991 | Thornton | 307/35 |
| 5,233,509 | 8/1993 | Ghorbi | 363/89 |

FOREIGN PATENT DOCUMENTS

| | | |
|---|---|---|
| 1615126 | 5/1972 | Germany . |
| 2608295 | 9/1977 | Germany . |
| 2914304 | 10/1979 | Germany . |
| 3415967C2 | 5/1990 | Germany . |
| 1202816 | 8/1970 | United Kingdom . |
| 1319318 | 6/1973 | United Kingdom . |
| 1368216 | 9/1974 | United Kingdom . |

OTHER PUBLICATIONS

Revue Generale de l'Electricite (RGE), Feb. 1988, pp. 55–62.

Electronics Letters, Mar. 1988, pp. 439–440.

*Primary Examiner*—Bruce A. Reynolds
*Assistant Examiner*—Tu Hoang
*Attorney, Agent, or Firm*—Bell, Seltzer, Park & Gibson

[57] ABSTRACT

A godet for heating an advancing yarn including a rotatably mounted godet casing of magnetically conductive material, a stationary primary winding, and a power supply for powering the primary winding at least about 300 Hz. The godet casing is formed of iron and acts as both the secondary winding and core for the primary winding. Accordingly, the godet casing does not need a separate and defined secondary winding, nor does the godet casing include a copper insert or copper coating on the interior of the casing.

11 Claims, 2 Drawing Sheets

GODET FOR HEATING AN ADVANCING YARN

FIELD OF THE INVENTION

The invention relates to the field of textile equipment, and more particularly to a godet for heating an advancing yarn.

BACKGROUND OF THE INVENTION

A godet for heating an advancing yarn is disclosed in German Patent DE-A 33 16 744. In the godet, the frequency of the primary current is variably controlled as a function of the measured temperature so that the temperature can be kept constant. In maintaining the temperature constant by controlling the frequency, however, it is unavoidable that at a lower energy demand, the frequency lies in electrically and/or magnetically unfavorable ranges. The advantage of the good controllability is therefore obtained at the expense of impaired efficiency and an increase in the power loss to be dissipated.

The godet disclosed in German Application DE-OS 16 60 215 is operated at a constant primary frequency-To control the temperature, the primary circuit is connected and disconnected in time intervals dependent on the measured temperature. This godet does not exhibit the aforesaid decrease in efficiency. However, a secondary winding is necessary which is highly conductive and which consists of a copper or brass ring which is securely connected to the inner circumference of the magnetic iron casing of the godet. Such a secondary winding, which must be firmly and securely connected to the godet casing under all types of thermal and mechanical stresses, is difficult and expensive to manufacture.

German Patent 18 04 777 discloses a godet which is additionally provided with a hollow casing filled, in part, with a fluid and in addition with the vapor of this fluid. This godet achieves good temperature uniformity over the entire length of the godet. The disadvantage of this approach lies again in its expense and complexity.

OBJECT AND SUMMARY OF THE INVENTION

It is the object of the present invention to do without the expense of an electrically highly conductive secondary winding, for example, of copper, which is firmly connected to the casing of the godet.

This and other objects are achieved according to the present invention by a godet including a stationary primary winding, a magnetically conductive godet casing rotatably supported and concentric with the primary winding and which is inductively connected with the primary winding via a narrow gap to generate secondary currents in the casing, and power supply means connected to the primary winding for operating same at an alternating current of an adjustable frequency of at least about 300 Hz. The godet casing is formed of magnetically conductive material to serve exclusively as both a core and a secondary winding for the primary winding and, therefore, does not include a defined secondary winding and, in particular, does not include a copper insert nor a copper coating.

In a preferred embodiment of the invention, the adjustment of the frequency effects an optimization of the cosine of the angle between the voltage and current, that is, the power factor, to be greater than or equal to 0.9. This optimization is dependent not only on the electrical layout of the primary winding, but also on the mechanical design of the godet and the distribution of its magnetically conductive masses. It has been found that the frequency range of higher than 900 Hz, preferably higher than 1000 Hz, and most preferably between 1000 Hz and 2000 Hz, permits the godet to be operated at the desired power factor.

An improvement of the uniformity of the temperature distribution over the axial length of the godet is provided by axially arranging a series of windings in side-by-side relation and separated from one another by common cross pieces, or flux poles, of their respective iron cores. The present invention can be utilized particularly advantageously with this arrangement of windings and makes up for the disadvantages of such an arrangement. The disadvantages are that the cross-pieces extending between the individual windings reduce the cross-sectional surface of the electrical conductors available to serve as the primary winding and also reduces the possible number of windings of these conductors. On the primary side, this leads to increased electrical losses and, due to the reduced number of windings, to an impairment of the power factor which indicates the ratio of the usable effective power to the apparent power absorbed.

Preferably each individual winding of the primary winding is included in an oscillating circuit operated at a predetermined ac frequency and which can be triggered with a predetermined pulse sequence. Thus, it is possible to coordinate the desired and optimal ac frequency by adjusting the oscillating circuit parameters, in particular, the inductance of the primary winding and the capacitance.

The oscillating circuit is triggered preferably via power switches which can also be driven by a predetermined pulse sequence. This trigger action may be effected by a fixedly predetermined pulse sequence. According to another feature of the invention, temperature control is also provided. Therefore, it is also preferable to activate the power switches by the predetermined pulse sequence in trigger intervals with the duration of the trigger intervals being dependent on the temperature of the godet casing. This temperature is measured by a temperature sensor which is arranged on the godet casing in the inductive sphere of influence of the primary winding.

The oscillating circuits provide for the switching of only low currents at low load voltages. The power switches serve simultaneously as switches and as inputs in the oscillating circuits. A particularly high power factor of almost 1 is made possible. Accordingly, the two power switches which are associated each to a primary winding are switched on in a half-bridge circuit with the same direction of current and with a constant dc voltage applied to a dc bus circuit, and triggered via a trigger circuit with a fixed predetermined pulse sequence. This trigger action can also be started and stopped by a temperature controller as a function of the temperature measured in the region of the associated primary winding. Each primary winding is associated with such an individual winding.

A unique feature of the invention is that the inverters serve simultaneously as power switches, thereby making it possible to build up the oscillating circuit with the inductance of the primary winding and an additional capacitor. This oscillating circuit is connected to an alternating current whose amplitude is half the voltage of the dc bus circuit. The inductance of the primary winding and the capacitance of the capacitor are coordinated such that the supply frequency of the oscillating circuit is somewhat greater than the resonant frequency of the oscillating circuit. In this manner, it is possible to operate the transistors which serve as power switches in the almost currentless condition in the deenergized state. Thus, the components of the inverter are subjected only to a defined and small load even in the switching phase.

DETAILED DESCRIPTION OF THE PREFERRED EMBODIMENT

Figure 1:
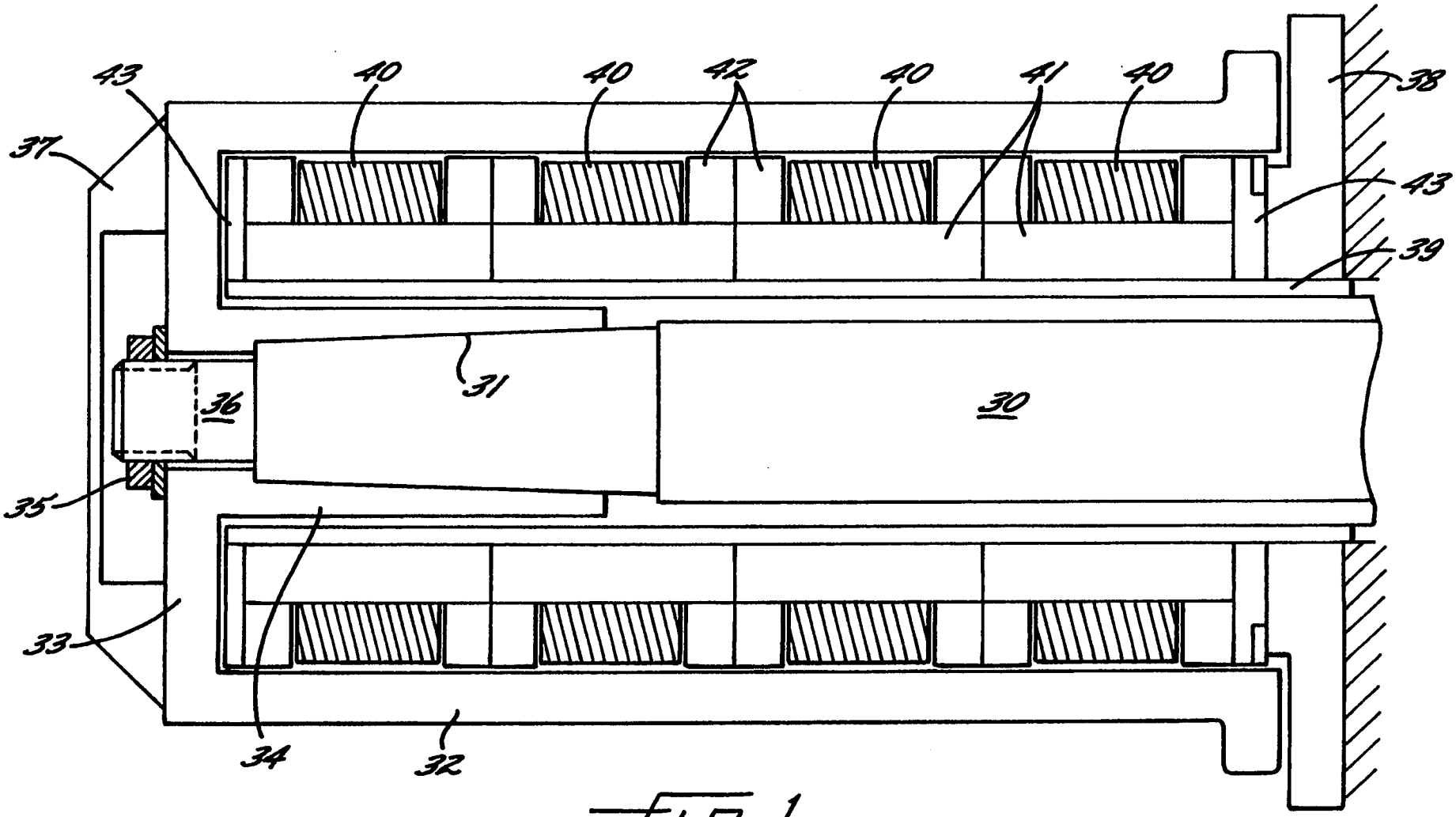
FIG. 1 is a cross-sectional axial view of a multi-zone godet according to the invention.

The godet of FIG. 1 is arranged secured against rotation on a rotatably driven, overhung shaft 30. To this end, the shaft 30 possesses at its free end a taper 31 and a concentric screw 36 adjacent thereto. Attached to the conical end 31 of the godet is a casing 32. The godet casing 32 is a circular cylinder which surrounds concentrically the shaft 30 and is open on the bearing side of the shaft 30. The opposite front side of the godet casing 32 is closed by a cover 33. The cover 33 is firmly connected with a hub 34 which is directed into the interior of the godet casing 32. The hub 34 contains a taper bore mating with the taper at the front end of shaft 30. The hub is slipped over this taper 31 of shaft 30 and firmly locked in position by means of a nut 35 which is screwed on a bolt 36. A protective cap 37 is located in front on the cover 33.

It should be emphasized that the inside diameter of the godet casing is larger than the outside diameter of the hub 34 and the shaft 30. Thus, an annular space is formed between the inner circumference of the godet casing 32 and the outer circumference of the hub 34 and shaft 30. This annular space is filled by a package of individual primary windings which are arranged stationarily and unmovingly. To this end, a cooling tube 39 concentric with shaft 30 is attached to a stationary holder 38. The cooling tube projects into the aforesaid annular space and extends up to the front cover 33. It should be emphasized that the cooling tube 39 is stationary and surrounds the shaft 30 concentrically and without contacting it.

Arranged on the cooling tube 39 are four zones with individual primary windings 40. Each package of an individual primary winding comprises a flux tube 41, flux poles 42 as well as the individual primary winding 40. The flux tubes 41 and flux poles 42 consist of a magnetically highly conductive material. Each flux tube extends into the range of a respective individual primary winding. Fixedly attached to the ends of the tubes 41 are two annular flux poles 42. One individual primary winding 40 each is arranged between two flux poles 42. The thus formed packages are threaded with the flux tubes 41 on the cooling tube 39 with a narrow clearance and are held in position with the holder by longitudinal screws, there being further provided flux disks 43 at the end of the entire package.

The outside diameter of the flux poles 42 is only slightly smaller than the inside diameter of the godet casing 32. The godet casing 32 consists of a magnetically conductive material, primarily iron, and contains no copper inserts whatsoever or inserts or coatings of an electrically highly conductive material, thereby reducing considerably the cost of the godet casing. Further, the manufacture of such a godet casing is technically simple. Primarily however, the godet casing becomes more robust, since with godet casings of the conventional type the risk is incurred that the electrically conductive coatings or insert become detached.

It should be emphasized in particular that, as is common practice, the godet casing 32 is freely rotatable and rotatingly driven relative to the winding packages. Power is supplied to the primary windings 40 via the stationary holder 38 according to the circuit diagram of FIG. 2.

Figure 2:
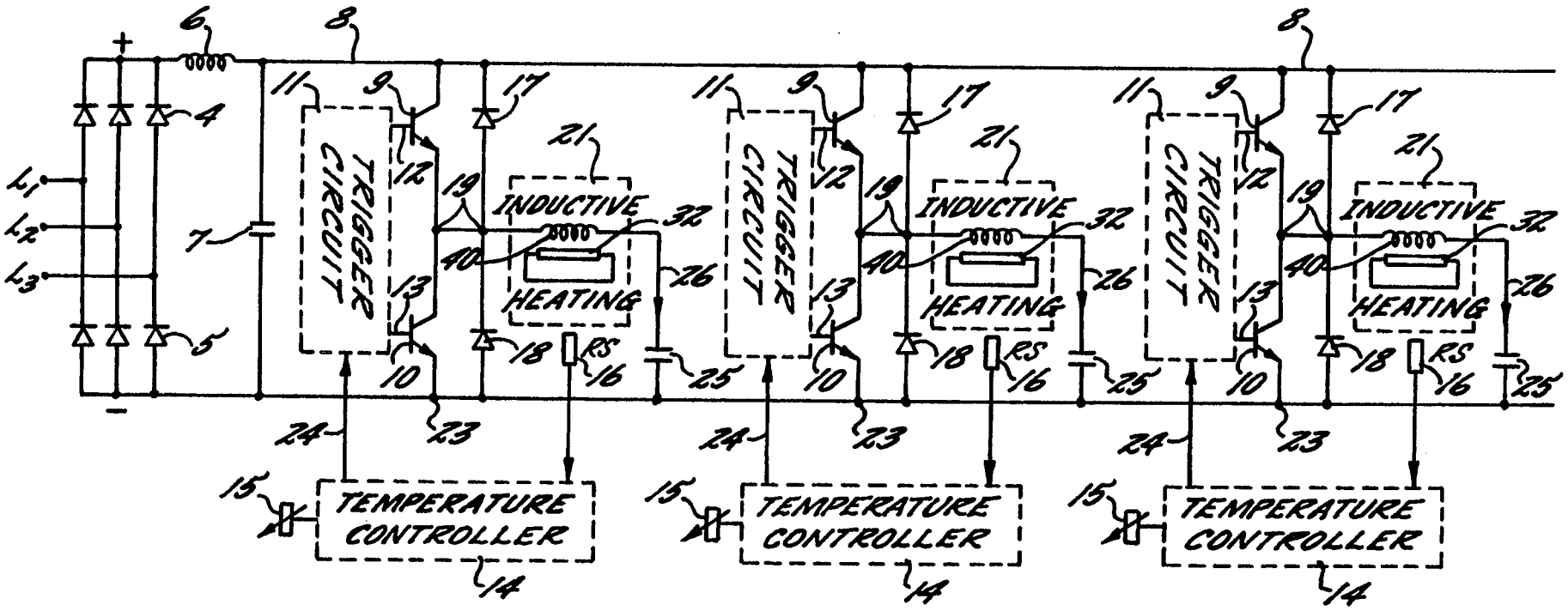
FIG. 2 is a schematic wiring diagram of a multi-zone godet showing three individual windings arranged in side-by-side relation in the axial direction.

According to the circuit diagram of FIG. 2, the power is supplied by the phases L1, L2, L3 of a three-phase current network. Rectifiers 4 and 5, as well as choking coil 6 and capacitor 7 rectify and smooth the three-phase current. As a result, a direct current (dc) voltage bus circuit is formed with a positive leg e and a negative leg. This dc voltage bus circuit energizes three individual primary windings 40 of the godet. These individual primary windings are arranged coaxially with one another and stationarily inside the rotating iron casing 32 of the godet (FIG. 1), with the primary windings extending between legs 42 of the iron package, which are constructed as radial rings and are U-shaped in their axial section. One leg each is common to the adjacent primary windings (see, for example, German Patent 16 60 232). Such a multi-zone godet achieves good temperature distribution over the length of the godet casing when the godet casing is provided with a temperature sensor 16 adjacent to each of the primary windings. Such a temperature sensor may be glued or otherwise attached, for example, to the inside surface of the godet jacket. See also, German Patent 16 60 215.

The power supply to each primary winding comprises transistors 9 and 10 which are connected in series and with the same direction of current flow between the two legs of the dc bus circuit. Further, the power supply of each primary winding includes a trigger circuit 11. This commercially available trigger circuit 11 permits turning on or off the transistors 9 and 10 at a predetermined frequency. These two switching conditions are predetermined by a temperature controller 14 which is connected with the trigger circuit 11 via a line 24.

The temperature controller itself is triggered on the one side by the aforesaid temperature sensor 16, and on the other side by a reference input element 15. As a function of the temperature measured by the temperature sensor 16, the trigger circuit is connected, when the temperature is below the reference input, such that a predetermined trigger voltage is supplied to transistors 9 and 10 via lines 12 and 13 with a fixedly preset pulse sequence, such at the supply frequency of the oscillating circuit, or that the transistors 9 and 10 are turned off, when the predetermined reference input temperature is exceeded.

The transistors 9 and 10 of each power supply are connected through diodes 17, 18 in a half-bridge circuit with the dc bus circuit 8. Arranged between the midpoint 19 of the half-bridge and one of the two legs, as shown the negative leg of the dc bus circuit, is the individual primary winding 40 respectively associated thereto for the inductive heating of one godet zone.

The secondary winding is shown in the circuit diagram of FIG. 2 as an electrical symbol for an inductance, which is however within the scope of the present invention not of a standard conductor material, such as in particular copper or brass, but is exclusively the iron casing of the godet. Within the scope of the present invention, the iron casing of the godet has the double function of (a) an electrical conductor of the secondary winding forming a single winding, and (b) the iron core of the secondary winding.

In FIG. 2, the inductively heated godet is indicated only schematically by the numeral 21.

The individual primary winding of each heating zone is connected with the aforesaid leg of the dc bus circuit via a capacitor 25. As a result, the primary winding 20 and the capacitor 25 form an oscillating circuit which is energized by means of transistor 10 in the operating phases with a pulsating dc current having a predetermined supply frequency and half the voltage of the dc bus circuit. By setting the capacitance of capacitor 25 to the inductance of the primary winding 40, the natural frequency of the oscillating circuit is rated preferably somewhat lower than the supply frequency of the oscillating circuit, which is predetermined by the trigger circuit 11. This causes essentially no current to flow when the trigger circuit 11 turns off the transistors 9 and 10.

The trigger circuit is adjusted such that the transistors 9 and 10 are triggered at a frequency which is above 500 Hz. An upward limit is set by the load capacity of the components, in particular the diodes and transistors, by the switching losses of the transistors, as well as the increasing losses of the circuit on the primary side. Practically, a limit for the optimal frequency should be at 2000 Hz. Good results were obtained with a frequency adjusted to 1500 Hz. In particular in the range between 1000 and 2000 Hz, it is possible, without adversely affecting the components, to use the transistors 9 and 10 which serve as inverters, simultaneously for the connection and disconnection of the primary circuit.

The voltage waveform would show a pulsating dc voltage in the operating phases. The amplitude of this dc voltage amounts to 250 volts, when the voltage drop of the dc intermediate circuit is 500 volts. Thus, it is necessary to switch only half the operating voltage of the dc intermediate circuit on the power switches (transistors) 9, 10. The frequency can be preset fixed and invariable. In the quiescent phase, the disconnection occurs only when the voltage equals zero. This occurs, as provided above, by properly adjusting the oscillating circuit which consists of inductance 20 and capacitance 25. The quiescent phase will be switched, when the temperature measured on sensor 16 exceeds the desired temperature set on reference input element 15.

In the drawings and specification, there has been set forth a preferred embodiment of the invention, and although specific terms are employed, they are used in a generic and descriptive sense only and not for purposes of limitation.

That which is claimed is:

1. A godet for heating an advancing yarn, comprising:

a stationary primary winding;

a godet casing rotatably supported and concentric with said primary winding, said godet casing comprising magnetically conductive material to serve exclusively as both a core and a secondary winding for said primary winding, said godet casing being inductively connected with said primary winding via a narrow gap to thereby generate secondary currents in said godet casing to heat said godet casing; and power supply means connected to said primary winding for operating same at an alternating current of an adjustable predetermined frequency of at least about 300 Hz, said power supply means further comprising matching means for delivering power to said primary winding at a power factor of greater than about 0.9 at the predetermined frequency of said power supply means.

2. A godet as in claim 1 wherein said power supply means includes means for operating said primary winding at an alternating current of an adjustable predetermined frequency of at least about 500 Hz.

3. A godet according to claim 1 wherein said matching means comprises a predetermined capacitance connected in series with said primary winding.

4. A godet as in claim 1 wherein said power supply means includes means for operating said primary winding at an alternating current of an adjustable predetermined frequency of at least about 900 Hz.

5. A godet as in claim 1 wherein said power supply means includes means for operating said primary winding at an alternating current of an adjustable predetermined frequency of at least about 1000 Hz.

6. A godet as in claim 5 wherein said power supply means includes means for operating said primary winding at an alternating current of an adjustable predetermined frequency of not greater than about 2000 Hz.

7. A godet as in claim 1 wherein said primary winding comprises a series of windings axially arranged in side-by-side relation in said godet casing; wherein each of said windings includes a pair of flux poles on opposite ends thereof and a portion of a magnetic core for said windings; and wherein said series of windings are separated from one another by respective flux poles.

8. A godet as in claim 7 wherein said power supply means comprises a respective oscillator circuit including each winding of said primary winding; and wherein each respective oscillator circuit includes means for operating a respective winding at a predetermined frequency responsive to triggering by a predetermined pulse sequence.

9. A godet as in claim 8 wherein said power supply means comprises a direct current bus circuit including power switches; and wherein said direct current bus circuit also includes means for triggering each oscillating circuit with a predetermined pulse sequence via respective power switches.

10. A godet as in claim 9 wherein each oscillator circuit further comprises a pair, of electronic power switches arranged as a half bridge between opposite legs of the direct current bus circuit and a capacitor connected to one leg of said direct current bus circuit; and wherein a respective winding for each of said oscillator circuits is connected between the midpoint of the two electronic power switches and said capacitor.

11. A godet as in claim 10 wherein each oscillator circuit further comprises a temperature sensor for a respective winding of said primary winding and a temperature controller operatively connected to said temperature sensor and corresponding power switches for triggering same with a pulse sequence having a predetermined frequency to maintain said primary winding within a predetermined temperature range.

* * * * *